United States Patent [19]

Altenburger

[11] 4,062,561

[45] Dec. 13, 1977

[54] SKI BRAKE

[76] Inventor: Karl Altenburger, Rue de Veraie 4, Montreux-Territet, Switzerland

[21] Appl. No.: 671,503

[22] Filed: Mar. 29, 1976

[30] Foreign Application Priority Data

Jan. 12, 1976 Germany ..... 2600850

[51] Int. Cl.[2] ..... A63C 7/10

[52] U.S. Cl. ..... 280/605

[58] Field of Search ..... 280/605, 604, 12 AB; 188/8, 5, 6, 7

[56] References Cited

U.S. PATENT DOCUMENTS

| | | | |
|---|---|---|---|
| 3,877,709 | 4/1975 | Fritz | 280/605 |
| 3,899,185 | 8/1975 | Martin | 280/605 |
| 3,917,297 | 11/1975 | Fruh | 280/605 |

FOREIGN PATENT DOCUMENTS

| | | | |
|---|---|---|---|
| 2,311,316 | 9/1973 | Germany | 280/605 |

*Primary Examiner*—Joseph F. Peters, Jr.
*Assistant Examiner*—Milton L. Smith
*Attorney, Agent, or Firm*—Werner W. Kleeman

[57] ABSTRACT

A ski brake for a ski embodying two brake vanes pivotable from a preparatory position above the running surface of the associated ski downwardly into a ski braking position. The brake vanes also can be retained against the action of springs in a position above the ski running surface in a so-called arrested position for storage and transport of the skis. Movable latch bolts cooperate with the brake vanes to ensure that the arrested position is assumed only when the ski boot is released from the ski. A pressure plate engageable by the ski boot and connected by a cable to the latch bolts moves the bolts to shift the ski brake automatically from the arrested position into the preparatory position when the ski boot is secured to the ski.

14 Claims, 5 Drawing Figures

SKI BRAKE

BACKGROUND OF THE INVENTION

The present invention relates to a new and improved construction of a brake mechanism for skis, conventionally referred to in the art as a ski brake.

Generally speaking, the ski brake for use by skiers of this development is of the type incorporating two brake vanes or flaps which can be rocked out of a position above the running surface of a ski downwardly into a braking position. The brake vanes can be locked, against the action of springs, in a position above the running surface of the ski constituting an arrested position for storage and transport of the skis, and further, can be locked in a preparatory position by means of a latching arrangement when the ski is secured to the boot of the skier. The latching arrangement encompasses bushings mounted rigidly against rotation which are beveled at their outer ends and axially pressable, against spring force, into the base of the brake vane and bolts interconnected by a yoke and possessing a tapered end of lesser diameter than the inner diamter of the bushings and arranged to be axially displaceable in alignment with the bushings in a web extending transversely over the ski and neighboring the outer end of the pushed-in bushings. Moreover, in the arrested position the bushings enter the bores in the web taking-up the bolts. In the preparatory position they can be forwardly displaced out of the web by one of the ski boots located upon the ski against the action of a control mechanism which can be depressed by a spring, in such a manner that they enter into the bushings, push such out of the bores of the web and fixedly hold such in an eccentric position with regard to the axes of the bolts in the pivotal direction of the brake vane, whereby the longer part of the bushing located in the pivotal direction bears externally of the bores at the web.

Such type brake mechanism is known from German patent publication 2,311,316 in conjunction with German patent publication 2,106,108. With the known device the bolts are actuated by a control mechanism embodying two tension or traction elements extending along the lateral lengthwise edges of the ski. These traction elements can be displaced in axial direction with the aid of a bracket which can be depressed by the sole of the ski boot and are connected with a yoke extending in the transverse direction of the ski and located at the rear side of the brake mechanism. The yoke carries the bolts. Both of the traction elements of the control mechanism require a considerable constructional expenditure and need a certain amount of space on the ski. The traction elements are disturbing particularly at the inner edges of the skis which most often abut one another during skiing. Under some circumstances the traction element on one ski can become ensnarled with that on the other ski or damaged. Furthermore, the lengthwise adjustment of the traction element of each brake mechanism is relatively complicated, since it is necessary to make sure that the yoke carrying the bolts uniformly moves at both sides thereof since the bolts otherwise would tend to tilt or cant or only lockingly snap-in or snap-out at one side.

SUMMARY OF THE INVENTION

Hence, it is a primary object of the present invention to provide a new and improved construction of ski brake which is not associated with the aforementioned drawbacks and limitations of the prior art proposals.

Another and more specific object of the present invention aims at improving upon the prior art ski brake of the previously mentioned type in a manner that there is simplified the control of the locking or latch operation.

Now in order to implement these and still further objects of the invention, which will become more readily apparent as the description proceeds, the brake mechanism of this development is manifested by the features that the yoke or crosspiece connecting the bolts is connected between the bolts to a traction rod extending in the lengthwise direction of the ski, the free end of which is pivotably connected to the central region of a lever which is supported at one end. The other end of this lever is connected to a traction element extending along a side of the ski and can be shifted in a lengthwise direction by means of the control mechanism which can be activated by the ski boot.

The control mechanism preferably encompasses a hingeshaped pressure plate arranged at the region of the support surface of the sole of the ski boot, a first bracket of which is pivotably mounted at its free edge to the ski and the second bracket thereof is displaceably guided with its free edge at the surface of the ski and is connected to the traction element at the region of the last-mentioned free edge.

In accordance with a preferred exemplary embodiment of the invention the hinge axis or shaft of the pressure plate extends parallel to the lengthwise axis of the ski. The first bracket is mounted with its free edge at a lateral edge of the ski, whereas the free edge of the second bracket is displaceable transversely across the ski. The traction element is a traction cable which is deflected through an arc of about 90° beneath the pressure plate.

The pressure plate is preferably mounted in a holder which bounds the pressure plate by means of two webs extending perpendicular to the hinge axis. The webs are provided at the side confronting the pressure plate with a groove for the reception of a guide pin connected to the free edge of the second bracket and accommodating a pivot shaft which is connected to the free edge of the first bracket.

Continuing, there is preferably provided a plate formed of elastic material between the webs and limiting the upwardly pivoted terminal position of the pressure plate. This plate has piercingly extending therethrough the traction cable. The traction cable can piercingly extend through the guide pin connected with the second bracket and be fixed thereto. At the inside of the arc of the deflected traction cable there can be secured between the webs an arcuate-shaped guide plate for guiding the traction cable and provided with a groove.

The holder preferably forms a mounting unit provided with a base plate connecting the webs, and upon which mounting unit there is secured the guide plate and the plate of elastic material between the webs.

The traction cable can be equipped with an adjustment device for effectuating length changes.

The brake vanes or flaps are preferably mounted upon a support plate on shafts and which support plate is secured to the ski, these shafts extending between two upright webs at the front and rear edge of the support plate and bounding at the lateral edges of the ski and at the same time receive helical springs for pre-biasing the brake vanes in the braking direction. The helical or spiral springs can be fixed at one end to the brake vanes and at the other end to externally rotatable heads of the shaft located in front of the front web, whereas the shafts can be blocked by set screws in the rear web.

In accordance with a preferred exemplary embodiment of the invention the bolts of the latching arrangement can be guided in the rear web and at their free end initially conically taper and at their terminal region possess a cylindrical construction with reduced diameter. The bushings or sleeves displaceably arranged in the brake vanes are preferably formed of one-piece with a guide pin extending out of the one side of the brake vane and at that location possessing a stop or impact head and exhibit a noncircular guide region. Moreover, they are pre-biased by helical or spiral springs supported internally of the brake vanes in the sense of bringing about contact or abutment of the stop heads and departure of the bushings out of the brake vanes.

By means of the control of the arresting- and the preparatory position as well as the release of the brake vanes by means of a single traction element there is not only simplified the construction of the ski brake, but also the adjustment is facilitated. Moreover, there is insured that the bolts of the latching arrangement are always displaced symmetrically and uniformly, so that there are eliminated actuation errors with regard to the brake vanes.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
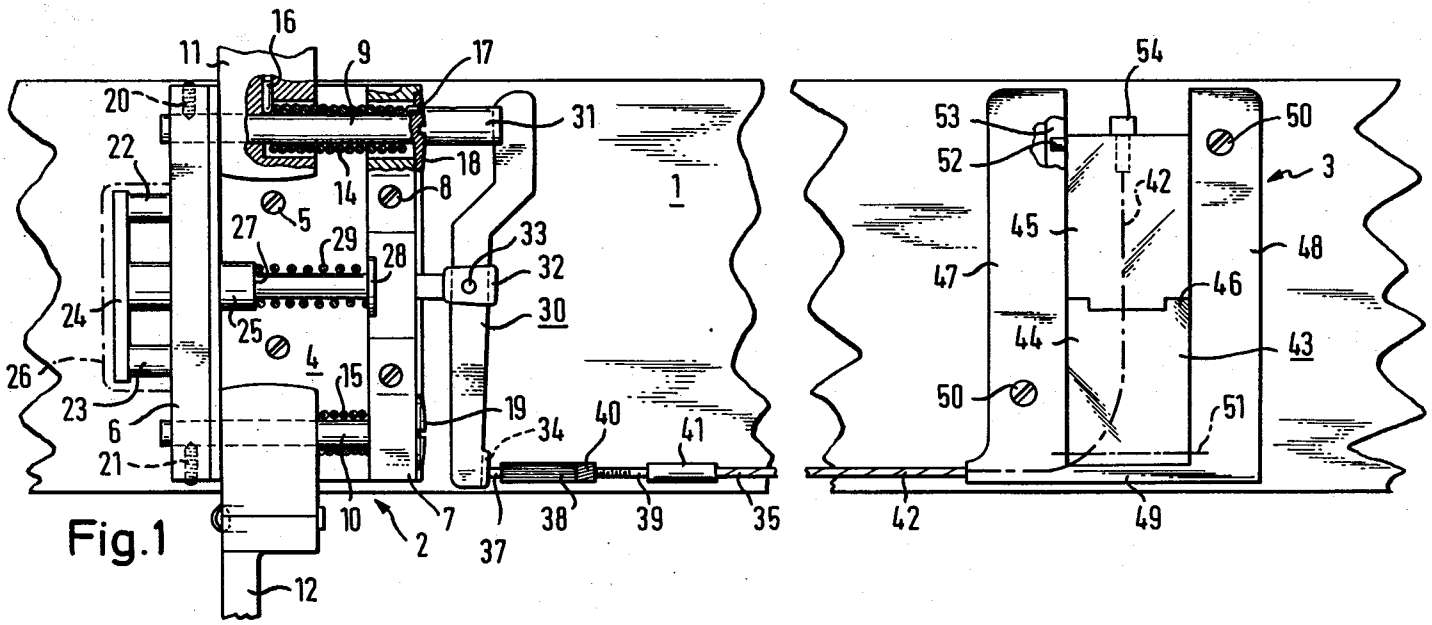
FIG. 1 is a plan view of a brake mechanism designed according to the present invention and located on a partially illustrated ski.

Describing now the drawings, in FIG. 1 reference character 1 denotes a partially illustrated ski upon which there has been shown the exemplary embodiment of brake mechanism of the present invention. Such encompasses a brake portion 2 and a control portion 3, the brake portion 2 typically being arranged behind the rear jaw or heel holder of a ski binding and the control portion 3 being arranged at the region beneath the sole of a not particularly illustrated ski boot. The brake portion 2 is arranged upon a support plate 4 which is secured to the ski 1 by the indicated screws 5 or equivalent structure. At the rear edge of the support plate 4 a web or strap 6 extends transversely across the ski. Web 6 is formed of one-piece with the support plate 4 and at the front edge of the support plate 4 there is attached by screws 8 or equivalent structure a web or strap 7 extending essentially parallel to the first web 6.

Between the webs 6 and 7 there extend at the region of the lengthwise edges of the ski 1 two shafts 9 and 10 upon which there are pivotably mounted the brake vanes or flaps 11 and 12. The brake vanes 11 and 12 can be rocked into a ski brake or braking position in a plane beneath the running surface 13 of the ski 1 and thus exert a braking effort upon the ski. Furthermore, the shafts 9 and 10 carry helical or spiral springs 14 and 15, the extended or flexed ends 16, 17 of which are mounted on the brake vanes 11, 12 and on a head or head member 18, 19 respectively, which are connected with the shafts 9, 10 in front of the front web 7 and possess an appropriate bore. The heads 18, 19 each possess a not particularly referenced slot or the like for receiving a tool, so that the helical springs 14, 15 can be selectively stressed or biased by rotating the shafts 9 and 10. The shafts 9, 10 then can be fixed by the indicated set screws 20, 21 or equivalent structure which laterally enter the rear web 6. In this way the brake vanes 11, 12 are always pre-biased into the lower braking position.

The control of the position of the brake vanes 11, 12 occurs with the aid of two bolts 22, 23 extending parallel to the lengthwise direction of the ski 1 and piercing the web 6 through appropriate bores from the rear towards the front. Details concerning these bolts 22,23 will be discussed more fully hereinafter. The bolts 22,23 are rigidly connected with one another at the rear face or side of the web 6 by means of a transversely extending yoke or crosspiece 24. In the middle of this yoke or crosspiece 24 there extends parallel to and between the bolts 22,23 a traction or pull rod 25 which likewise penetrates through the rear web 6. The arrangement consisting of the bolts 22,23, the yoke or crosspiece 24 and the traction rod 25 is covered by a phantom line illustrated cap 26 or the like at the rear of the web 6, so that there is eliminated any hindering of the movement of the bolts 22,23 by snow and ice.

The diameter of the traction rod 25 decreases between the webs 6,7 so as to form a shoulder 27. Between this shoulder 27 and a disk 28 bearing against the front web 7 there is supported a helical compression spring 29. Furthermore, the traction rod 25 likewise penetrates through the front web or strap 7. By means of the helical compression spring 29 it is pre-biased into a rearward terminal position, the position of which is fixed by the control mechanism or device to be discussed more fully hereinafter.

The springs 14,15,29 can be surrounded by plastic sleeves or the like to protect the same against the effects of snow and ice.

The traction or pull rod 25 is pivotally connected in front of the front web 7 to a lever 30 extending transversely across the ski. At its upper end, as shown in FIG. 1, this lever 30 bears in a slot of a pin 31 which is inserted at this region into the support plate 4, for instance pressed therein.

Figure 2:
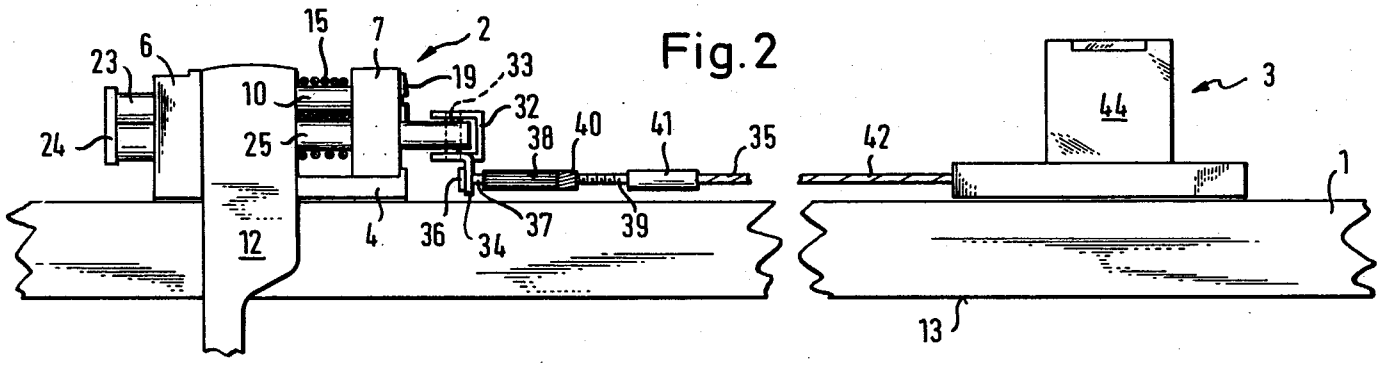
FIG. 2 is a side view of the arrangement of FIG. 1.

At the central region the lever 30 carries a substantially U-shaped flexed bracket 32, the legs of which engage over the end of the traction rod 25 and are penetrated by a pin 33 which at the same time penetrates the traction rod 25 and provides a pivotal or hinge connection, as best seen by referring to FIG. 2. The lower end of the lever 30 shown in FIG. 1 likewise carries a bracket 34 which is flexed or bent at right angles, in which there is fixed the end of a traction or pull cable 35. This traction cable 35 comprises a rod 37 fixed by a head 36 to the bracket 34 and a nut member or nut 38 is rotatably arranged on the rod 37. Threaded into the nut 38 is a further rod 39 which is provided with threading at its end confronting the nut 38. Upon this threading there is also provided a check nut or counter nut 40. This arrangement permits a lengthwise adjustment of the traction cable 35. The rod 39 is connected via a clamp 41 to the further traction cable, for instance a wire cable 42.

The traction cable 35 extends from the lower edge of the ski of FIG. 1 up to the control portion or component 3. Control portion 3 comprises as the actual control element a pressure plate 43. The pressure plate 43 encompasses two rectangular brackets 44, 45 which are connected to one another at a hinge axis or shaft 46. To both sides of the pressure plate 45 there extend transversely across the ski 1 two webs 47, 48 which are connected to one side of the ski by means of a transverse web 49 and in totality are mounted on a not particularly illustrated base plate. The arrangement composed of the webs 47, 48, 49 and the base plate is secured by screws 50 or equivalent structure to the ski. The bracket 44 of the pressure plate 43 is pivotably mounted at the lower edge of the ski of FIG. 1 to a phantom line shown shaft 51 between the webs 47,48. At the upper edge of FIG. 1 the other bracket 45 is connected to a guide pin 52 laterally protruding past the bracket. This guide pin 52 is displaceably guided in the transverse direction of the ski in grooves 53 provided at the confronting inner surfaces of the webs 47, 48. The guide pin 52 furthermore is pierced by the phantom line illustrated wire cable 42 which is fixed by a head 54 with regard to the guide pin 52. Now when the guide pin 52 moves downwardly in the grooves 53 of FIG. 1, the pressure plate 43 rocks upwardly at the hinge axis 46, as illustrated in FIG. 2. Consequently, the traction cable is relieved or slackened in the direction of the brake portion 2. By depressing the pressure plate 43 through the action of a ski boot which is located upon the ski the traction cable 35 is tensioned towards the right of FIG. 1, so that the lever 30 is rocked towards the right and the traction rod 25, while overcoming the pressure force of the helical compression spring 29, is likewise moved towards the right of FIG. 1. Consequently, the bolts 22,23 are shifted towards the right of FIG. 1 out of the web 6, as will be explained more fully hereinafter with reference to FIGS. 3 and 4.

Figure 3:
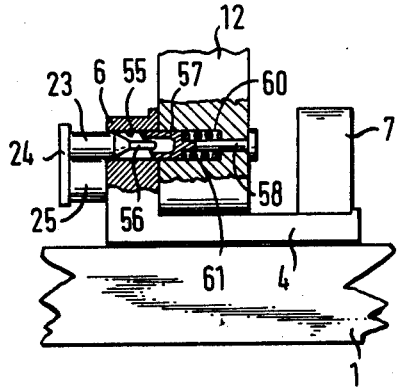
FIG. 3 is a partially sectional side view of the latching arrangement.
Figure 4:
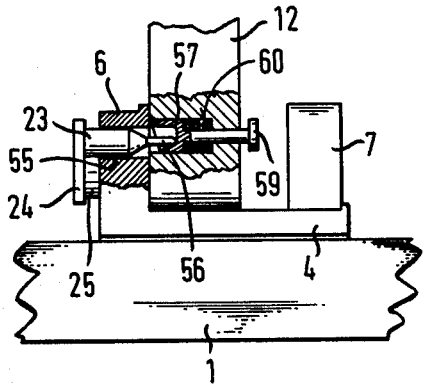
FIG. 4 is a view corresponding to the showing of FIG. 3 but with a different operating position of the components.

FIGS. 3 and 4 illustrate the mode of operation of the bolt 23, but the bolt 22 operates in the same manner and in synchronism with the bolt 23 since both are connected by the yoke or crosspiece 24. The bolt 23 piercingly extends to be lengthwise displaceable into a bore 55 in the web 6. In the region located within the bore 55 the bolt 23 first conically tapers and then forms a cylindrical end 56 of reduced diameter. FIG. 3 further shows the brake vane 12 in a rocked position where it is located above the ski 1. In this position a bushing or sleeve 57 is axially aligned with the bore 55 in the web 6. The bushing 57 is formed of one-piece with a guide pin 58 which extends to the front face or side of the brake vane 12 and at that location is terminated by a stop head 59. In a recess or bore 60 in the brake vane 12 there is located a helical compression or pressure spring 61 which pre-biases the arrangement of the bushing 57 and guide pin 58 in the sense of causing contact of the stop head 59 against the brake vane 12 and a departure of the bushing 57 out of the bore which guides the same. The arrangement of the bushing 57 and guide pin 58 is provided at a suitable location, for instance at the periphery of the bushing 57, with a round, for instance, square cross-section, which in conjunction with an appropriate shape of the bore receiving the same prevents a rotation, but permits axial displacement.

At its free end shown at the left-hand side of FIG. 3 the bushing 57 is beveled or tapered so that the upper end shown in FIGS. 3 and 4 and in the operating position is longer than the lower end. Moreover, the inner diameter of the bushing 57 is larger than the outer diameter of the end 56 of the bolt 23. The outer diameter of the bushing 57 corresponds to the inner diameter of the bore 55 in the web 6. Under these circumstances the bushing 57 enters the bore 55 when the brake vane is rocked into a position above the ski. In this position the brake vane is latched or locked. One is dealing with the so-called arrested position in which the brake vane can be arrested, for instance during transport or when storing the skis. Such arrested position is advantageous for reasons of convenience, however there should be prevented that it is only then released when the skier, upon putting on the ski, intentially undertakes a release or reversing operation which possibly can be forgotten. It is therefore important that the arrested position is automatically released upon putting on the skis. In the illustrated example this occurs in that the bolt 23 according to FIG. 4 is shifted towards the right of FIG. 4 via the arrangement composed of the pressure plate 43, traction cable 35, lever 30, traction rod 25 and yoke or crosspiece 24. With this operation the outer end 56 of the bolt 23 engages the base or floor of the bushing 57 and pushes such out of the bore 55. Since the brake vane 12 is under the pre-bias of the helical spring 15 it is rocked in the direction of the brake position below the ski when the bushing 57 departs out of the bore 55. This rocking motion, however, is limited to a very small path, since the end 56 of the bolt 23 is located in the bushing 57. A certain rocking however occurs in that the diameter of the end 56 of the bolt 23 is smaller than the inner diameter of the bushing 57, as above mentioned. Owing to this rocking the bushing 57 loses its alignment with the bolt 23, so that the longer end of the bushing, as shown in FIG. 4, is located in contact with the web 6 outside of the bore 55 and there is prevented that the bushing 57 can again enter the bore 55. This position shown in FIG. 4 is the so-called preparatory position in which the brake vane 12 is indeed positively fixedly held above the ski, but at the same time there is eliminated that it can again be locked in the arrested position of FIG. 3. Here one is dealing with the position which is assumed when skiing.

Now if the boot is released from the ski, as such sometimes happens when the skier falls, then the pressure plate 43 is released. Consequently, the traction cable 35 is slackened or de-tensioned in the already described manner and the helical compression spring 29 pushes the traction rod 25 towards the left of FIG. 1 and towards the rear with regard to the ski. Consequently, the bolts 22, 23 are retracted out of the bushing 57 of FIG. 4, and the end 56 of the bolt again enters the interior of the bore 55 in the web 6. With this position of the bolt 23 the bushing or sleeve 57 can slidingly move further upwardly in the showing of FIG. 4 past the web 6. This movement corresponds to the pivotal movement of the brake vane 12 into the brake position under the influence of the helical spring 15.

With this mechanism it thus will be apparent that the arrested position then only can be assumed after the ski has been released from the boot, and the arrested position automatically goes over into the preparatory position when the ski is connected with the ski boot. The skier therefore does not have any possibility of continually blocking the brake vanes in the arrested position or forgetting to switch the mechanism into the preparatory position or preparatory mode.

Figure 5:
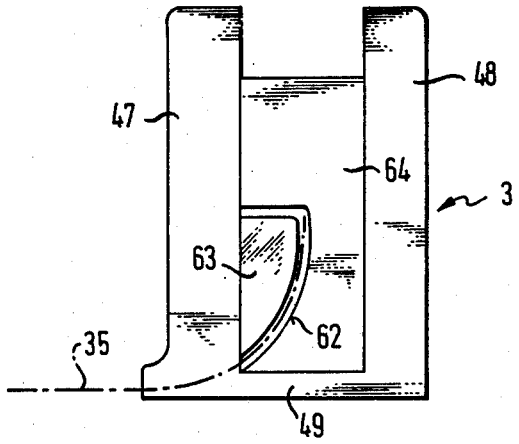
FIG. 5 is a plan view of part of the control mechanism with the pressure plate omitted for clarity in illustration.

FIG. 5 corresponds to the right-hand portion of FIG. 1 and shows the control portion 3, wherein however there has been omitted for clarity in illustration the pressure plate 43. The phantom line illustrated traction cable 35 enters in the lower marginal region of the web 47 of FIG. 5 and extends along an arcuate-shaped guide path or track 62 through an angle of 90° in the direction of the guide rod 52 of the bracket 45, which guide rod has not been shown in FIG. 5 to simplifiy the drawing. Internally of the arcuate-shaped guide track there is located a guide plate 63 formed of a hard material but still permitting sliding of the traction cable, this guide plate possessing at its end surface confronting the traction cable a not further illustrated guide groove. After leaving the guide plate 63 the traction cable passes through a plate 64 of elastic material which occupies the remaining surface between the webs 47, 48 and at the same time serves as the stop for the guide pin 52. The plates 63,64 are secured to a not particularly illustrated base plate which at the same time connects the webs 47,48.

While there is shown and described present preferred embodiments of the invention, it is to be distinctly understood that the invention is not limited thereto, but may be otherwise variously emnbodied and practiced within the scope of the following claims. ACCORDINGLY,

What is claimed is:

1. A brake mechanism for skis having a running surface, comprising two brake vanes, means pivotably mounting said brake vanes for movement from a position above the running surface of the ski downwardly into a ski braking position, spring means acting upon said brake vanes to bias said vanes into the ski braking position, and latching means for holding the brake vanes in an arrested position for storage and transport of the skis and in a preparatory position when the skier's ski boot is secured to the ski, said latching means comprising for each brake vane a bushing, said bushing being beveled at its end, each brake vane having a bore for receiving the bushing, a spring biasing the bushing, each said bushing being urgable against the force of the spring towards the base of the bore of the associated brake vane, a bolt provided for each bushing, a yoke interconnecting said bolts, a first web extending transversely across the ski, each bolt possessing a tapered end of lesser diameter than the inner diameter of the bushings and arranged to be axially displaceable in said first web in alignment with the associated bushing, said first web being provided with bores for receiving the bushings in the arrested position of the ski brake and for taking-up the bolts, control means for the ski brake, the brake vanes in the preparatory position having the bushings forwardly displaced out of the first web against the action of the control means such that the bolts enter the bushings, push such out of the bores of the first web and fixedly hold such in an eccentric position with regard to the axes of the bolts, said yoke interconnecting the bolts being connected between the bolts to a traction rod extending in the lengthwise direction of the ski, said traction rod having a free end, a lever having an intermediate portion, means for supporting the lever at one end, means for pivotably connecting the intermediate portion of the lever to the free end of the traction rod, a traction element extending along a side edge of the ski with which there is connected the other end of the lever, said traction element being shiftable in its lengthwise direction by the control means which can be activated by the ski boot.

2. The brake mechanism as defined in claim 1, wherein said control means comprises a pressure plate arranged on the ski at a region of a support surface for the sole of the ski boot, said pressure plate having a first bracket and a second bracket, said first bracket having a free edge, means for mounting the first bracket pivotably to the ski at the region of its free edge, said second bracket having a free edge, means for guiding the second bracket with its free edge displaceable at the surface of the ski, said second bracket being connected at the region of its free edge with the traction element.

3. The brake mechanism as defined in claim 2, wherein the pressure plate includes a hinge axis means extending essentially parallel to the lengthwise axis of the ski, the first bracket is pivotably mounted at a lateral edge of the ski and the second bracket is displaceable with its free edge tranversely of the ski, and the traction element comprises a traction cable deflected beneath the pressure plate through an arc of about 90°.

4. The brake mechanism as defined in claim 3, further including holder means for mounting the pressure plate, said holder means bounding the pressure plate to two webs extending substantially perpendicular to the hinge axis means, said webs being provided at the sides thereof confronting the pressure plate with groove means for the reception of a guide pin connected to the free edge of the second bracket and accommodating a pivot shaft connected to the free edge of the first bracket, said pivot shaft defining said means for mounting the first bracket.

5. The brake mechanism as defined in claim 4, further including a plate member formed of elastic material between the webs and limiting the upward terminal pivotal position of the pressure plate, said plate member having piercingly extending therethrough the traction cable.

6. The brake mechanism as defined in claim 5, wherein the traction cable piercingly extends through the guide pin and is fixed thereto.

7. The brake mechanism as defined in claim 5, wherein the holder means defines a mounting unit interconnecting the webs, the plate member of elastic material being secured to the mounting unit.

8. The brake mechanism as defined in claim 4, wherein at the inside of the arc of the deflected traction cable there is secured between the webs a guide plate for guiding the traction cable, said guide plate being provided with a groove means.

9. The brake mechanism as defined in claim 3, wherein the traction cable is provided with adjustment means for lengthwise adjustment thereof.

10. The brake mechanism as defined in claim 1, said means pivotably mounting said brake vanes including a support plate secured to the ski, a pair of shafts mounted on the support plate, the brake vanes being mounted on the shafts, a pair of upright webs at the front and rear of the support plate defining said first web and a second web, said shaft extending between said pair of upright webs, said spring means acting upon said brake vanes comprising helical spring means mounted on the shafts for pre-biasing the brake vanes in the ski braking direction.

11. The brake mechanism as defined in claim 10, wherein the helical spring means are secured to the brake vanes and to head means for the shafts located forwardly of the second web, and wherein said shafts are blocked by set screws on the first web.

12. The brake mechanism as defined in claim 1, wherein the bolts of the latching means which are guided in the first web each have a free end which has a substantially conical portion followed by a substantially cylindrical end of reduced diameter.

13. The brake mechanism as defined in claim 1, wherein each bushing displaceably arranged in the associated brake vane is formed of one-piece with a guide pin protruding out of a predetermined side of the brake vane and forming a stop head, a helical spring surrounding the guide pin for prebiasing the bushing so as to cause abutment of the stop head with the brake vane and at least partial departure of the bushing out of the bore of the brake vane.

14. A brake mechanism for a ski having a running surface, said brake mechanism comprising two brake vanes, means pivotably mounting each brake vane for movement from a position above the running surface of the ski downwardly into a ski braking position, spring means acting upon said brake vanes to bias said vanes into the ski braking position, latching means for holding the brake vanes in a preparatory position when the skier's ski boot is secured to the ski, control means for the brake mechanism, said latching means comprising a web extending transversely across the ski, said web having bores, a bolt provided for each brake vane for releasing the brake vane from its preparatory position to its braking position, said bolts being axially guided and displaceable in the bores of said web, a yoke interconnecting said bolts, a traction rod extending in the lengthwise direction of the ski and connected to said yoke between said bolts, said traction rod having a free end, a lever having two ends and a central portion, one end of said lever pivotably supported adjacent one side of the ski, means pivotably connecting said central lever portion with the free end of said traction rod, a traction element having two ends and extending along the other side of the ski, one end of said traction element connected to said control means, the other end of said traction element connected to the other end of said lever, said traction element being shiftable in the lengthwise direction thereof by said control means to permit release of said brake vanes by said bolts.

* * * * *